US005620952A

United States Patent [19]

Fu et al.

[11] Patent Number: 5,620,952

[45] Date of Patent: Apr. 15, 1997

[54] FLUID COMPOSITIONS CONTAINING POLYHYDROXY FATTY ACID AMIDES

[75] Inventors: Yi-Chang Fu, Wyoming, Ohio; Peter R. Foley; Julie A. Dyet, both of Newcastle upon Tyne, England; Peter G. Mather, Brussels, Belgium; Robert Mermelstein, Cincinnati; Brian J. Roselle, Fairfield, both of Ohio

[73] Assignee: The Procter & Gamble Company, Cincinnati, Ohio

[21] Appl. No.: 614,922

[22] Filed: Mar. 11, 1996

Related U.S. Application Data

[63] Continuation of Ser. No. 255,292, Jun. 7, 1994, abandoned, which is a continuation of Ser. No. 13,981, Feb. 19, 1993, abandoned, which is a continuation-in-part of Ser. No. 851,432, Mar. 16, 1992, abandoned.

[51] Int. Cl.[6] ..... C11D 1/66; C11D 3/32; C11D 3/20

[52] U.S. Cl. ..... 510/350; 510/336; 510/337; 510/361; 510/433; 510/434; 510/501

[58] Field of Search ..... 510/336, 337, 510/350, 361, 433, 434, 501

[56] References Cited

U.S. PATENT DOCUMENTS

| | | | |
|---|---|---|---|
| 2,703,798 | 3/1955 | Schwartz | 252/211 |
| 3,893,955 | 7/1975 | Hewitt et al. | 252/551 |
| 4,092,273 | 5/1978 | Inamorato et al. | 252/548 |
| 5,009,814 | 4/1991 | Kelkenberg et al. | 252/174.21 |
| 5,057,246 | 10/1991 | Bertho et al. | 252/545 |
| 5,174,927 | 12/1992 | Honsa | 252/543 |
| 5,283,009 | 2/1994 | Speckman et al. | 252/548 |
| 5,332,528 | 7/1994 | Pan et al. | 252/548 |
| 5,512,699 | 4/1996 | Connor et al. | 564/153 |
| 5,545,354 | 8/1996 | Ofosu-Asante | 510/237 |

OTHER PUBLICATIONS

H. Kelkenberg, Tenside Surfactants Detergents 25 (1988) no month available pp. 6–13 "Detergents Based on Sugars".

*Primary Examiner*—Douglas J. McGinty
*Assistant Examiner*—Gregory R. Delcotto
*Attorney, Agent, or Firm*—Jerry J. Yetter

[57] ABSTRACT

Stock solutions of polyhydroxy fatty acid amide surfactants at high concentrations are characterized by their unfortunate tendency to thicken, or gel, on storage. Mild heating and the inclusion of carboxylates such as oxydisuccinate, citrate or tartrate-succinate maintain the viscosity of such solutions below about 2,000 centipoise, even at temperatures around 30° C.

1 Claim, No Drawings

FLUID COMPOSITIONS CONTAINING POLYHYDROXY FATTY ACID AMIDES

This application is a continuation of application Ser. No. 08/255,292, now abandoned filed Jun. 7, 1994; which is a continuation of application Ser. No. 08/013,981, filed Feb. 19, 1993, now abandoned; which is a continuation-in-part of application Ser. No. 07/851,432, filed Mar. 16, 1992, now abandoned.

FIELD OF THE INVENTION

The present invention relates to a process improvement relating to the manufacture of detergent compositions, especially laundry and dishwashing detergents.

BACKGROUND OF THE INVENTION

The manufacturer may find it desirable to add any number of detersive and aesthetic ingredients to modern laundry detergent compositions using various handling techniques. For example, some sensitive ingredients such as enzymes and perfumes may be added by dry-mixing or by spraying onto a final granular product. The formulation of liquid detergents can involve various batch or continuous processes which may include various solubilizing, mixing, pH-adjusting, etc., steps. Such procedures have become well-known and commonplace in the detergent industry, and various batch, continuous and mixed continuous/batch processes for the manufacture of detergent compositions are currently in use.

Depending on the method of manufacture, the type of detergent composition being manufactured and the available equipment, it may be desirable for the manufacturer to employ various ingredients as stock solutions which are in fluid form. This is especially true when formulating liquid detergents. Typically, fluid forms of detersive ingredients comprise water or water-alcohol as the fluidizing medium in which the desired ingredients can be dissolved or slurried.

While detersive surfactants are mainly water-soluble, it is well-known to those skilled in the detergency arts that various surfactants often form quite viscous fluids, or even high viscosity pasty masses or gels, when added to water at high concentrations. Such high viscosity materials can be difficult to work with in a manufacturing plant. Of course, one simple method to avoid handling problems is either to work with such surfactants in their substantially dry, solid state, to use them in a more dilute, more easily handleable, fluid form, or to heat them to provide fluidity.

However, in the event the manufacturer wishes to employ surfactants in the form of fluids which are stable and relatively highly concentrated, it is generally advantageous to adjust such fluids so that they are easier to handle, especially with regard to their ability to be pumped using conventional pumping equipment. On the other hand, it would be undesirable to add any ingredients to such surfactant-containing fluids which could not be tolerated in the finished detergent compositions, since to do so would require additional steps in the overall manufacturing process to remove such unwanted ingredients.

The polyhydroxy fatty acid amides comprise one class of surfactants which are currently being investigated for use in detergent compositions. One problem with this class of surfactants is that concentrated aqueous solutions containing them tend to precipitate and/or gel on storage, even at elevated temperatures (35°–60° C.). Moreover, low temperature storage of this family of amide surfactants is of great importance, since at elevated temperatures they are susceptible to degradation via hydrolysis of the amide bond to give the amine and the fatty acid. For polyhydroxy fatty acid amides stored below 35° C. this degradation is negligible, i.e., less than 5–10% per year, but at elevated temperatures it becomes highly significant, rising to about 10% per month at 50° C. and about 20–25% per month at 60° C.

Of course, it may be possible to employ various organic solvents to reduce the viscosity of concentrated solutions of polyhydroxy fatty acid amide surfactants. However, use of solvents such as ethanol, or even high concentration ethanol/water mixtures, can be problematic on a commercial scale due to issues involving government regulations, potential flammability and handling problems, and the like. Moreover, excessive amounts of even nonflammable solvents can be problematic since, if carried over into finished liquid detergent compositions, they can lower the viscosity of such end-product compositions to an undesirable extent. Accordingly, the use of high concentrations of organic solvents remains but a theoretical possibility to the commercial-scale detergent manufacturer.

Having due regard for the foregoing considerations, the present invention provides a method for preparing storage-stable, pumpable fluid compositions which contain relatively high concentrations of polyhydroxy fatty acid amide surfactants. Moreover, the invention provides such fluid compositions using ingredients which are either innocuous in the finished detergent composition, or which can provide desirable benefits to said finished compositions. Accordingly, removal of such ingredients is not required.

BACKGROUND ART

The manufacture of polyhydroxy fatty acid amines is disclosed in the art. The following references are illustrative of manufacturing processes: U.S. Pat. No. 2,016,962, Flint et al, issued Oct. 8, 1935; U.S. Pat. No. 1,985,424, Piggott, issued Dec. 25, 1934; U.S. Pat. No. 2,703,798, Schwartz, issued Mar. 8, 1955; U.S. Pat. No. 2,993,887, Zech, issued Jul. 25, 1961; Hildreth, Biochem. J., 1982, Vol. 207, pages 363–366; Thomas Hedley & Co. Ltd. (now Procter & Gamble), British Patent 809,060 published Feb. 18, 1959; EP-A 285,768, published Dec. 10, 1988 (see U.S. Pat. No. 5,009,814); and H. Kelkenberg, Tenside Surfactants Detergents 25 (1988) 8–13.

SUMMARY OF THE INVENTION

The process herein can readily provide solutions or slurries, conveniently comprising up to about 44% by weight of a polyhydroxy fatty acid amide surfactant, and can be readily used to reduce the viscosity of such solution or slurry of polyhydroxy fatty acid amide below about 2,000 centipoise (cp) to a preferred range of from about 1,200 cp to about 1,600 cp.

The invention thus encompasses an improved process for preparing a stable, concentrated, fluidized mixture of a polyhydroxy fatty acid amide surfactant of the type disclosed more fully hereinafter, comprising:

(a) preparing a stock mixture of said polyhydroxy fatty acid amide surfactant in an aqueous solvent comprising water or water containing minor amounts of organic, especially hydroxy, solvents;

(b) preheating said stock mixture to provide an isotropic solution of said polyhydroxy fatty acid amide in said aqueous sol vent;

(c) concurrently with or following step (b), adding an effective, viscosity controlling amount of a carboxylate functional material to said isotropic solution of polyhydroxy fatty acid amide, whereby the viscosity of said solution remains at a pumpable viscosity below about 2,000 centipoise, even when the solution is allowed to cool to a temperature of about 30.6° C. Typically, solutions prepared in the foregoing manner will remain as stable, pumpable liquids for a period up to about 7 weeks, or longer.

In a preferred mode, the minor amount of hydroxy solvent which optionally can be employed herein comprises a member selected from the group consisting of water, methanol, ethanol, 1,2-propanediol, and mixtures thereof. Such solvents are well tolerated in fully-formulated liquid detergent compositions. Water and mixtures of water and 1,2-propanediol are useful and typical solvents herein.

The carboxylate functional material employed herein can be a monocarboxylate such as acetate (or even carbonate), but is preferably a water-soluble dicarboxylate or, most preferably, a polycarboxylate detergency builder having three or more carboxyl groups which can remain together with the polyhydroxy fatty acid amide for inclusion into fully-formulated detergent compositions containing polyhydroxy fatty acid amides. Such carboxylate functional materials which additionally have builder characteristics include, but are not limited to: citrate, oxydisuccinate, tartrate, tartrate monosuccinate, tartrate disuccinate, gluconate, saccharate, and water-soluble salts thereof, especially the sodium, potassium and alkanolammonium salts. Mixtures of carboxylates can be used. The corresponding free acid or partially neutralized water-soluble salts thereof can also be used. Citrate and oxydisuccinate are preferred. While the amount used can vary depending on the particular polyhydroxy fatty acid amide, the desired final viscosity, and the temperature, as a general proposition about 2% (wt.) of any of the aforementioned carboxylate builders will maintain the viscosity of up to about a 44% (wt.) concentration isotropic solution of coconutalkyl N-methylglucamide below about 1,700 cp. at 40° C., and citrate will maintain the viscosity at about 1200 cp. The stability will typically be maintained at 30.6° C. for at least 7 weeks, which is ample time for transportation and/or storage of the solution prior to its being used to manufacture a finished detergent composition.

All percentages, ratios and proportions herein are by weight, unless otherwise specified.

DETAILED DESCRIPTION OF THE INVENTION

The following defines the process of this invention in greater detail.

By "concentrated mixture" herein is meant weight percentages of the polyhydroxy fatty acid amide typically in the range of about 30% to about 44%, or even up to about 55–60% if such high concentrations are desired by the formulator.

By "fluidized" or "pumpable" herein is meant a viscosity below about 2,000 cp, preferably below about 1,600 cp.

"Viscosity" is measured by means of a Brookfield Viscometer Model DVII with a Thermosel System. The viscosity of the systems is measured at 30.6° C. during storage to assess stability.

By "isotropic solution" herein is meant a homogeneous, fluid, nonbirefringent liquid. This can be estimated visually using polarized light, and can be confirmed using a microscope under polarized light.

By "heating to provide an isotropic solution" of the polyhydroxy fatty acid amide herein is meant, generally, heating to a temperature that provides the desired isotropic solution but does not degrade or, importantly, cyclize the polyhydroxy fatty acid amide. Generally, temperatures in the range of from about 50° C. to about 80° C. can be used. Temperatures above about 120° C. can be tolerated, if used for short periods of time, e.g., less than about 10–15 minutes.

By "effective viscosity controlling amount" of the carboxylate material herein is meant an amount that provides a solution viscosity in the desired range below about 2,000 cp. Typically, from about 1% to about 3% of the carboxylate will suffice, although some carboxylates, e.g., citrate, are more effective than others, e.g., gluconate, so appropriate adjustments in usage levels can be made by routine experimentation. If concentrations of the polyhydroxy fatty acid amide of up to about 60% are desired, the amount of carboxylate material can be increased to 10–15%, or higher so as to achieve viscosities of 1000 cp and below (at 35° C.).

By "minor amounts of organic solvents" herein is meant an amount of such solvents in water that, by themselves, do not lower the viscosities within the desired ranges afforded by this invention. Of course, this may vary depending upon the solvent. Thus, for methanol solvent a "minor amount" will typically constitute about 10%, or less; for ethanol, preferably about 5%, or less; and for 1,2-propane diol, about 15% or less. Higher amounts, e.g., 10% ethanol, can be used if concentrations of up to about 60% of the polyhydroxy fatty acid amide are desired in the final slurry at viscosities of 1000 cp (max) at 35° C. These "minor amounts" can also vary, depending on the alkyl chain length of the polyhydroxy fatty acid amide, the particular sugar moiety in the amide, and like factors.

A key advantage of the present invention is that it allows polyhydroxy fatty acid amide surfactants to be stored in concentrated, phase stable liquid form at relatively low temperatures. This phase stability is very important, inasmuch as one of the main problems with storage of aqueous polyhydroxy fatty acid amide systems is that they tend to precipitate and/or gel on storage, even at relatively elevated temperatures (35° C.–60° C.).

The choice of fatty chain length can also impact the ease with which these systems can be liquified. The reduction in structure on moving from the $C_{12}$ to the $C_{12/14}$ analogue makes it a little easier to produce liquids and provides a potential route to increasing concentrations to the 60% range, especially if somewhat shorter periods of stability, say, two weeks, can be tolerated by the formulator. However, heating to ca. 75° C. may be required to form the initial "liquid" state. This higher activity can be an important benefit, especially for heavy duty liquid laundry detergent applications.

In the practice of the present invention, the polyhydroxy fatty acid amides are prepared as disclosed in the SYNTHESIS section of this disclosure and are rendered more easily handleable, especially pumpable, by the procedures described in the MATERIALS HANDLING section, hereinafter.

SYNTHESIS

The amide-forming reaction herein can be illustrated by the formation of lauroyl N-methyl glucamide, as follows.

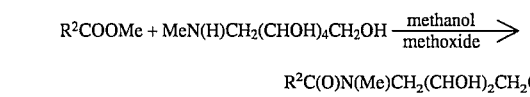

$$R^2COOMe + MeN(H)CH_2(CHOH)_4CH_2OH \xrightarrow[\text{methoxide}]{\text{methanol}} R^2C(O)N(Me)CH_2(CHOH)_2CH_2OH + MeOH$$

wherein $R^2$ is $C_{11}H_{23}$ alkyl.

More generally, the process herein can be used to prepare polyhydroxy fatty acid amide surfactants of the formula:

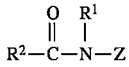

$$R^2-\overset{\overset{O}{\|}}{C}-\overset{\overset{R^1}{|}}{N}-Z \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or poly- saccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

It will be appreciated by those skilled in the chemical arts that the preparation of the polyhydroxy fatty acid amides herein using the di- and higher saccharides such as maltose will result in the formation of polyhydroxy fatty acid amides wherein linear substituent Z is "capped" by a polyhydroxy ring structure. Such materials are fully contemplated for use herein and do not depart from the spirit and scope of the invention as disclosed and claimed.

The following reactants, catalysts and solvents can conveniently be used herein, and are listed only by way of exemplification and not by way of limitation.

Reactants

Various fatty esters can be used herein, including mono-, di- and tri-esters ( i.e., triglycerides). Methyl esters, ethyl esters, and the like are all quite suitable. The polyhydroxyamine reactants include N-alkyl and N-hydroxyalkyl polyhydroxyamines with the N-substituent group such as $CH_3$—, $C_2H_5$—, $C_3H_7$—, $HOCH_2CH_2$—, and the like. (Polyhydroxyamines are often prepared by reaction sequences, one or more steps of which involve hydrogenation in the presence of metallic catalysts such as nickel. It is preferred that the polyhydroxyamines used herein not be contaminated by the presence of residual amounts of such catalysts, although a few parts per million [e.g., 10–20 ppm] can be present.) Mixtures of the ester and mixtures of the polyhydroxyamine reactants can also be used.

Catalysts

The catalysts used herein are basic materials such as the alkoxides (preferred), hydroxides (less preferred due to possible hydrolysis reactions, carbonates, and the like). Preferred alkoxide catalysts include the alkali metal $C_1$–$C_4$ alkoxides such as sodium methoxide, potassium ethoxide, and the like. The catalysts can be prepared separately from the reaction mixture, or can be generated in situ using an alkali metal such as sodium. For in situ generation, e.g., sodium metal in the methanol solvent, it is preferred that the other reactants not be present until catalyst generation is complete. The catalyst typically is used at 0.1–10, preferably 0.5–5, most preferably 1–3 mole percent of the ester reactant. Mixtures of catalysts can also be used.

Solvents

The hydroxy solvents herein include methanol, ethanol, propanol, iso-propanol, the butanols, glycerol, 1,2-propylene glycol, 1,3-propylene glycol, and the like. Methanol is a preferred alcohol solvent and 1,2-propylene glycol is a preferred diol solvent. Mixtures of solvents can also be used.

General Reaction Conditions

It is an objective herein to prepare the desired products while minimizing the formation of cyclized by-products, ester amides and color bodies. Reaction temperatures below about 135° C., typically in the range of from about 40° C. to about 100° C., preferably 50° C. to 80° C., are used to achieve this objective, especially in batch processes where reaction times are typically on the order of about 15–30 minutes, or even up to an hour. Somewhat higher temperatures can be tolerated in continuous processes, where residence times can be shorter.

EXAMPLE I

Typically, the industrial scale reaction sequence for preparing the preferred uncyclized polyhydroxy fatty acid amides will comprise: Step 1—preparing the N-alkyl polyhydroxy amine derivative from the desired sugar or sugar mixture, e.g., glucose syrup, high fructose corn syrup, and the like, by formation of an adduct of the N-alkyl amine and the sugar, followed by reaction with hydrogen in the presence of a catalyst; followed by Step 2—reacting the aforesaid polyhydroxy amine with, preferably, a fatty ester to form an amide bond. While a variety of N-alkyl polyhydroxy amines useful in Step 2 of the reaction sequence can be prepared by various art-disclosed processes, the following process is convenient and makes use of economical sugar syrup as the raw material. It is to be understood that, for best results when using such syrup raw materials, the manufacturer should select syrups that are quite light in color or, preferably, nearly colorless ("water-white").

Preparation of N-Alkyl Polyhydroxy Amine from Plant-Derived Sugar Syrup

I. Adduct Formation

The following is a standard process in which about 420 g of about 55% glucose solution (corn syrup—about 231 g glucose—about 1.28 moles) having a Gardner Color of less than 1 is reacted with about 119 g of about 50% aqueous methylamine (59.5 g of methylamine—1.92 moles) solution. The methylamine (MMA) solution is purged and shielded with $N_2$ and cooled to about 10° C., or less. The corn syrup is purged and shielded with $N_2$ at a temperature of about 10°–20° C. The corn syrup is added slowly to the MMA solution at the indicated reaction temperature as shown. The Gardner Color is measured at the indicated approximate times in minutes.

TABLE 1

| Time in Minutes: Reaction Temp. °C. | 10 | 30 | 60 | 120 | 180 | 240 |
|---|---|---|---|---|---|---|
| | Gardner Color (Approximate) | | | | | |
| 0 | 1 | 1 | 1 | 1 | 1 | 1 |
| 20 | 1 | 1 | 1 | 1 | 1 | 1 |
| 30 | 1 | 1 | 2 | 2 | 4 | 5 |
| 50 | 4 | 6 | 10 | — | — | — |

As can be seen from the above data, the Gardner Color for the adduct is much worse as the temperature is raised above about 30° C. and at about 50° C., the time that the adduct has a Gardner Color below 7 is only about 30 minutes. For longer reaction, and/or holding times, the temperature should be less than about 20° C. The Gardner Color should be less than about 7, and preferably less than about 4 for good color glucamine.

When one uses lower temperatures for forming the adduct, the time to reach substantial equilibrium concentration of the adduct is shortened by the use of higher ratios of amine to sugar. With the 1.5:1 mole ratio of amine to sugar noted, equilibrium is reached in about two hours at a reaction temperature of about 30° C. At a 1.2:1 mole ratio, under the same conditions, the time is at least about three hours. For good color, the combination of amine:sugar ratio; reaction temperature; and reaction time is selected to achieve substantially equilibrium conversion, e.g., more than about 90%, preferably more than about 95%, even more preferably more than about 99%, based upon the sugar, and a color that is less than about 7, preferably less than about 4, more preferably less than about 1, for the adduct.

Using the above process at a reaction temperature of less than about 20° C. and corn syrups with different Gardner Colors as indicated, the MMA adduct color (after substantial equilibrium is reached in at least about two hours) is as indicated.

TABLE 2

| | Gardner Color (Approximate) | | | | | | |
|---|---|---|---|---|---|---|---|
| Corn syrup | 1 | 1 | 1 | 1+ | 0 | 0 | 0+ |
| Adduct | 3 | 4/5 | 7/8 | 7/8 | 1 | 2 | 1 |

As can be seen from the above, the starting sugar material must be very near colorless in order to consistently have adduct that is acceptable. When the sugar has a Gardner Color of about 1, the adduct is sometimes acceptable and sometimes not acceptable. When the Gardner Color is above 1 the resulting adduct is unacceptable. The better the initial color of the sugar, the better is the color of the adduct.

II. Hydrogen Reaction

Adduct from the above having a Gardner Color of 1 or less is hydrogenated according to the following procedure.

About 539 g of adduct in water and about 23.1 g of United Catalyst G49B Ni catalyst are added to a one liter autoclave and purged two times with 200 psig $H_2$ at about 20° C. The $H_2$ pressure is raised to about 1400 psi and the temperature is raised to about 50° C. The pressure is then raised to about 1600 psig and the temperature is held at about 50°–55° C. for about three hours. The product is about 95% hydrogenated at this point. The temperature is then raised to about 85° C. for about 30 minutes and the reaction mixture is decanted and the catalyst is filtered out. The product, after removal of water and MMA by evaporation, is about 95% N-methyl glucamine, a white powder.

The above procedure is repeated with about 23.1 g of Raney Ni catalyst with the following changes. The catalyst is washed three times and the reactor, with the catalyst in the reactor, is purged twice with 200 psig $H_2$ and the reactor is pressurized with $H_2$ at 1600 psig for two hours, the pressure is released at one hour and the reactor is repressurized to 1600 psig. The adduct is then pumped into the reactor which is at 200 psig and 20° C., and the reactor is purged with 200 psig $H_2$, etc., as above.

The resulting product in each case is greater than about 95% N-methyl glucamine; has less than about 10 ppm Ni based upon the glucamine; and has a solution color of less than about Gardner 2.

The crude N-methyl glucamine is color stable to about 140° C. for a short time.

It is important to have good adduct that has low sugar content (less than about 5%, preferably less than about 1%) and a good color (less than about 7, preferably less than about 4 Gardner, more preferably less than about 1).

In another reaction, adduct is prepared starting with about 159 g of about 50% methylamine in water, which is purged and shielded with $N_2$ at about 10°–20 C. About 330 g of about 70% corn syrup (near water-white) is degassed with $N_2$ at about 50° C. and is added slowly to the methylamine solution at a temperature of less than about 20° C. The solution is mixed for about 30 minutes to give about 95% adduct that is a very light yellow solution.

About 190 g of adduct in water and about 9 g of United Catalyst G49B Ni catalyst are added to a 200 ml autoclave and purged three times with $H_2$ at about 20° C. The $H_2$ pressure is raised to about 200 psi and the temperature is raised to about 50° C. The pressure is raised to 250 psi and the temperature is held at about 50°–55° C. for about three hours. The product, which is about 95% hydrogenated at this point, is then raised to a temperature of about 85° C. for about 30 minutes and the product, after removal of water and evaporation, is about 95% N-methyl glucamine, a white powder.

It is also important to minimize contact between adduct and catalyst when the $H_2$ pressure is less than about 1000 psig to minimize Ni content in the glucamine. The nickel content in the N-methyl glucamine in this reaction is about 100 ppm as compared to the less than 10 ppm in the previous reaction.

The following reactions with $H_2$ are run for direct comparison of reaction temperature effects.

A 200 ml autoclave reactor is used following typical procedures similar to those set forth above to make adduct and to run the hydrogen reaction at various temperatures.

Adduct for use in making glucamine is prepared by combining about 420 g of about 55% glucose (corn syrup) solution (231 g glucose; 1.28 moles) (the solution is made using 99DE corn syrup from CarGill, the solution having a color less than Gardner 1) and about 119 g of 50% methylamine (59.5 g MMA; 1.92 moles) (from Air Products).

The reaction procedure is as follows:

1. Add about 119 g of the 50% methylamine solution to a $N_2$ purged reactor, shield with $N_2$ and cool down to less than about 10° C.
2. Degas and/or purge the 55% corn syrup solution at 10°–20° C. with $N_2$ to remove oxygen in the solution.
3. Slowly add the corn syrup solution to the methylamine solution and keep the temperature less than about 20° C.
4. Once all corn syrup solution is added in, agitate for about 1–2 hours.

The adduct is used for the hydrogen reaction right after making, or is stored at low temperature to prevent further degradation.

The glucamine adduct hydrogen reactions are as follows:

1. Add about 134 g adduct (color less than about Gardner 1) and about 5.8 g G49B Ni to a 200 ml autoclave.
2. Purge the reaction mix with about 200 psi $H_2$ twice at about 20°–30° C.
3. Pressure with $H_2$ to about 400 psi and raise the temperature to about 50° C.
4. Raise pressure to about 500 psi, react for about 3 hours. Keep temperature at about 50°–55° C. Take Sample 1.
5. Raise temperature to about 85° C. for about 30 minutes.
6. Decant and filter out the Ni catalyst. Take Sample 2.

Conditions for constant temperature reactions:

1. Add about 134 g adduct and about 5.8 g G49B Ni to a 200 ml autoclave.
2. Purge with about 200 psi $H_2$ twice at low temperature.
3. Pressure with $H_2$ to about 400 psi and raise temperature to about 50° C.
4. Raise pressure to about 500 psi, react for about 3.5 hours. Keep temperature at indicated temperature.
5. Decant and filter out the Ni catalyst. Sample 3 is for about 50°–55° C.; Sample 4 is for about 75° C.; and Sample 5 is for about 85° C. (The reaction time for about 85° C. is about 45 minutes.)

All runs give similar purity of N-methyl glucamine (about 94%); the Gardner Colors of the runs are similar right after reaction, but only the two-stage heat treatment gives good color stability; and the 85° C. run gives marginal color immediately after reaction.

EXAMPLE II

The preparation of the tallow (hardened) fatty acid amide of N-methyl maltamine for use in detergent compositions is as follows.

Step 1

Reactants: Maltose monohydrate (Aldrich, lot 01318KW); met amine (40 wt % in water) (Aldrich, lot 03325TM); Raney nickel, 50% slurry (UAD 52-73D, Aldrich, lot 12921LW).

The reactants are added to glass liner (250 g maltose, 428 g methylamine solution, 100 g catalyst slurry—50 g Raney Ni) and placed in 3 L rocking autoclave, which is purged with nitrogen (3×500 psig) and hydrogen (2×500 psig) and rocked under $H_2$ at room temperature over a weekend at temperatures ranging from 28° C. to 50° C. The crude reaction mixture is vacuum filtered 2× through a glass microfiber filter with a silica gel plug. The filtrate is concentrated to a viscous material. The final traces of water are azetroped off by dissolving the material in methanol and then removing the methanol/water on a rotary evaporator. Final drying is done under high vacuum. The crude product is dissolved in refluxing methanol, filtered, cooled to recrystallize, filtered and the filter cake is dried under vacuum at 35° C. This is cut #1. The filtrate is concentrated until a precipitate begins to form and is stored in a refrigerator overnight. The solid is filtered and dried under vacuum. This is cut #2. The filtrate is again concentrated to half its volume and a recrystallization is performed. Very little precipitate forms. A small quantity of ethanol is added and the solution is left in the freezer over a weekend. The solid material is filtered and dried under vacuum. The combined solids comprise N-methyl maltamine which is used in Step 2 of the overall synthesis.

Step 2

Reactants: N-methyl maltamine (from Step 1); hardened tallow methyl esters; sodium methoxide (25% in methanol); absolute methanol (solvent); mole ratio 1:1 amine:ester; initial catalyst level 10 mole % (w/r maltamine), raised to 20 mole %; solvent level 50% (wt.).

In a sealed bottle, 20.36 g of the tallow methyl ester is heated to its melting point (water bath) and loaded into a 250 ml 3-neck round-bottom flask with mechanical stirring. The flask is heated to ca. 70° C. to prevent the ester from solidifying. Separately, 25.0 g of N-methyl maltamine is combined with 45.36 g of methanol, and the resulting slurry is added to the tallow ester with good mixing. 1.51 g of 25% sodium methoxide in methanol is added. After four hours the reaction mixture has not clarified, so an additional 10 mole % of catalyst (to a total of 20 mole %) is added and the reaction is allowed to continue overnight (ca. 68° C.) after which time the mixture is clear. The reaction flask is then modified for distillation. The temperature is increased to 110° C. Distillation at atmospheric pressure is continued for 60 minutes. High vacuum distillation is then begun and continued for 14 minutes, at which time the product is very thick. The product is allowed to remain in the reaction flask at 110° C. (external temperature) for 60 minutes. The product is scraped from the flask and triturated in ethyl ether over a weekend. Ether is removed on a rotary evaporator and the product is stored in an oven overnight, and ground to a powder. Any remaining N-methyl maltamine is removed from the product using silica gel. A silica gel slurry in 100% methanol is loaded into a funnel and washed several times with 100% methanol. A concentrated sample of the product (20 g in 100 ml of 100% methanol) is loaded onto the silica gel and eluted several times using vacuum and several methanol washes. The collected eluant is evaporated to dryness (rotary evaporator). Any remaining tallow ester is removed by trituration in ethyl acetate overnight, followed by filtration. The filter cake is vacuum dried overnight. The product is the tallowalkyl N-methyl maltamide.

In an alternate mode, Step 1 of the foregoing reaction sequence can be conducted using commercial corn syrup comprising glucose or mixtures of glucose and, typically, 5%, or higher, maltose. The resulting polyhydroxy fatty acid amides and mixtures can be used in any of the detergent compositions herein.

In still another mode, Step 2 of the foregoing reaction sequence can be carried out in 1,2-propylene glycol or NEODOL. At the discretion of the formulator, the propylene glycol or NEODOL need not be removed from the reaction product prior to its use to formulate detergent compositions. Again, according to the desires of the formulator, the methoxide catalyst can be neutralized by citric acid to provide sodium citrate, which can remain in the polyhydroxy fatty acid amide.

In the following procedure the preparation of the N-alkylamine polyol is conducted in any well-stirred pressure vessel suitable for conducting hydrogenation reactions. In a convenient mode, a pressure reactor with a separate storage reservoir is employed. The reservoir (which, itself, can be pressurized) communicates with the reactor via suitable pipes, or the like. In use, a stirred slurry of the nickel catalyst is first treated with hydrogen to remove traces of nickel oxides. This can be conveniently done in the reactor. (Alternatively, if the manufacturer has access to an oxide-free source of nickel catalyst, pretreatment with $H_2$ is unnecessary. However, for most manufacturing processes some trace of oxides will inevitably be present, so the $H_2$ treatment is preferred.) After removal of excess slurry medium (water) the N-alkyl amine is introduced into the reactor. Thereafter, the sugar is introduced from the storage reservoir into the reactor either under hydrogen pressure or by means of a high pressure pumping system, and the reaction is allowed to proceed. The progress of the reaction can be monitored by periodically removing samples of the reaction mixture and analyzing for reducibles using gas chromatography ("g.c."), or by heating the sample to about 100° C. for 30–60 minutes in a sealed vial to check for color stability. Typically, for a reaction of about 8 liters (ca. 2 gallons) size the initial stage (to 95% of reducibles being depleted) requires about 60 minutes, depending somewhat on catalyst level and temperature. The temperature of the reaction mixture can then be raised to complete the reaction (to 99.9% of the reducibles being depleted).

EXAMPLE III

Catalyst Treatment

Approximately 300 mls of RANEY NICKEL 4200 (Grace Chemicals) is washed with deionized water (1 liter total volume; 3 washings) and decanted. The total catalyst solids can be determined by the volume-weight equation provided by Grace Chemicals, i.e., [(total wt. catalyst+water)–(water wt. for volume)]×7/6=Nickel solids.

308.21 g. of the catalyst Ni solids basis are loaded into a 2 gallon reactor (316 stainless steel baffled autoclave with DISPERSIMAX hollow shaft multi-blade impeller from Autoclave Engineers) with 4 liters of water. The reactor is heated to 130° C. at 1400–1600 psig hydrogen for 50 minutes. The mixture is cooled to room temperature at 1500 psig hydrogen and left overnight. The water is then removed to 10% of the reactor volume using an internal dip tube.

Reaction

The reactants are as follows. 881.82 mls. 50% aqueous monomethylamine (Air Products, Inc.; Lot 060-889-09); 2727.3 g. 55% glucose syrup (Cargill; 71% glucose; 99 dextrose equivalents; Lot 99M501).

The reactor containing the $H_2O$ and Raney nickel prepared as noted above is cooled to room temperature and ice cold monomethylamine is loaded into the reactor at ambient pressure with $H_2$ blanket. The reactor is pressurized to 1000 psig hydrogen and heated to 50° C. for several minutes. Stirring is maintained to assure absorption of $H_2$ in solution.

The glucose is maintained in a separate reservoir which is in closed communication with the reactor. The reservoir is pressurized to 4000 psig with hydrogen. The glucose (aqueous solution) is then transferred into the reactor under $H_2$ pressure over time. (This transfer can be monitored by the pressure change in the reservoir resulting from the decrease in volume of the sugar solution as it is transferred from the reservoir into the main reactor. The sugar can be transferred at various rates, but a transfer rate of ca.100 psig pressure drop per minute is convenient and requires about 20 minutes for the volume used in this run.) An exotherm occurs when the aqueous sugar solution is introduced into the reactor; the 50° C. internal temperature raises to ca. 53° C.

Once all the glucose has been transferred to the reactor the temperature is maintained at 50° C. for 30 minutes. Hydrogen uptake is monitored by a pressure gauge. Stirring is continued throughout at 800–1,100 rpm or greater.

The temperature of the reactor is increased to 60° C. for 40 minutes, then to 85° C. for 10 minutes, then to 100° C. for 10 minutes. The reactor is then cooled to room temperature and maintained under pressure overnight. The reaction product dissolved in the aqueous reaction medium is conveniently recovered by using an internal dip tube with hydrogen pressure. Particulate nickel can be removed by filtration. Preferably, an internal filter is used to avoid exposure to air, which can cause nickel dissolution. Solid N-methyl glucamine is recovered from the reaction product by evaporation of water.

The foregoing procedure is repeated using fructose as the sugar to prepare N-methyl fructamines.

Amidation with Fatty Ester

In this step of the process, the N-methyl glucamine prepared above is reacted with mixed tallow fatty acid methyl esters to prepare the corresponding tallowamide of N-methyl glucamine. It will be appreciated that coconut fatty acid methyl esters can be used in place of the tallow reactant, and various N-alkyl polyols, e.g., N-methyl fructamine, can be used in place of the N-methyl glucamine.

Reactants

N-methyl glucamine; hardened tallow methyl esters; sodium methoxide (25% in methanol); absolute methanol (solvent); mole ratio approximately 1:1 amine:ester; initial catalyst level 10 mole % (w/r glucamine), raised to 20 mole %; solvent level 50% (wt.).

In a sealed bottle, 20.36 g of the tallow methyl ester is heated to its melting point (water bath) and loaded into a 250 ml 3-neck round-bottom flask with mechanical stirring. The flask is heated to ca. 70° C. to prevent the ester from solidifying. Separately, 12.5 g of dry N-methyl glucamine is combined with 45.36 g of methanol, and the resulting slurry is added to the tallow ester with good mixing. 1.51 g of 25% sodium methoxide in methanol is added. If after about four hours the reaction mixture is not clarified, an additional 10 mole % of catalyst (to a total of 20 mole %) can be added and the reaction allowed to continue overnight (ca. 68° C.) after which time the mixture is clear. The reaction flask is then modified for distillation. The bath temperature is increased to 110° C. Distillation at atmospheric pressure is continued for 60 minutes. High vacuum distillation is then begun. The product is allowed to remain in the reaction flask at 110° C. (external temperature) for 60 minutes. The product is scraped from the flask and optionally triturated in ethyl ether over a weekend. Ether is removed on a rotary evaporator and the product is stored in an oven overnight, and ground to a powder. The reaction product can optionally be purified for analysis, as follows. Any remaining N-methyl glucamine is optionally removed from the product using silica gel. A silica gel slurry in 100% methanol is loaded into a funnel and washed several times with 100% methanol. A concentrated sample of the product (20 g in 100 ml of 100% methanol) is loaded onto the silica gel and eluted several times using vacuum and several methanol washes. The collected eluant is evaporated to dryness (rotary evaporator). Any remaining tallow ester is optionally removed by trituration in ethyl acetate overnight, followed by filtration. The filter cake is then vacuum dried overnight. The product is the purified tallowalkyl N-methyl glucamide. NOTE: Such a high level of purification is unnecessary for routine use of the tallowalkyl N-methyl glucamide in detergent compositions, since the product will typically have an acceptable Gardner Color by virtue of the quality of the N-alkyl glucamine prepared by the instant process. Accordingly, this purification step will be at the discretion of the formulator.

In another mode, the foregoing reaction sequence can be carried out in 1,2-propane diol or NEODOL. At the discretion of the formulator, the propylene glycol or NEODOL need not be removed from the reaction product prior to its use to formulate detergent compositions.

The amide of N-methyl fructamine is prepared in like manner.

MATERIALS HANDLING

Having thus disclosed in considerable detail the manufacture of polyhydroxy fatty acid amides, the following describes the practice of the prsent invention to enhance the handling properties, i.e., especially the viscosity, thereof. The following practical examples mainly illustrate the use of carboxyl detergency builder materials to achieve this desired goal, it will be appreciated that the other carboxyl materials noted hereinabove are also useful for this purpose. Accordingly, the following Examples are given by way of illustration, and not by way of limitation of the present invention. In the examples, untreated control had a viscosity in the 2,000 cp range. The pH is typically in the 5–9 range, preferably pH 7–9, in the final solution.

EXAMPLE IV

A composition comprising 40% (wt.) coconutalkyl N-methylglucamide in water solvent is heated to about 60° C. to form an isotropic solution. 2% by weight of citric acid (sodium salt form at pH 7–9; adjusted with NaOH) is admixed with the isotropic solution. The solution remains stable for at least 7 weeks at 30.6° C.; viscosity ca. 1,200 cp.

EXAMPLE V

The procedure of Example IV is repeated using 2% oxydisuccinate (sodium) to replace the sodium citrate. Stability for 7 weeks at 30.6° C. is achieved, at a viscosity of ca. 1,450 cp.

EXAMPLE VI

The procedure of Example IV is repeated using 2% sodium saccharate $NaO_2C(CHOH)_4CO_2Na$, sodium tartrate and mixed sodium tartrate monosuccinate/sodium tartrate disuccinate, respectively. Good stability is achieved in each instance, at a viscosity in the ca. 1,500–1,600 cp range. In a similar run, sodium gluconate provides stability at a viscosity of slightly above about 1,600 cp.

EXAMPLE VII

Any of the foregoing Examples IV, V or VI is repeated using water containing up to about 10% 1,2-propanediol or up to about 5% methanol solvent with substantially equivalent results.

EXAMPLE VIII

Any of the foregoing Examples is repeated with the tallowalkyl N-methylglucamide and fructamide surfactants and with the listed carboxylates or nitrilotriacetate, and viscosity lowering is achieved.

While the foregoing illustrates the practice of the invention, it is to be noted that further modifications are available which do not depart from its scope and spirit. Thus, various conventional hydrotropes such as sodium cumene sulfonate can also be added to the system at levels typically up to about 10%, preferably 6%–8%, at pH ca. 5–9, preferably about 7, to provide stable, low viscosity systems. This is particularly true with the lower chain length amides such as $C_{12}$ alkyl.

EXAMPLE IX

The procedure of Example IV is modified by the addition of 6% sodium cumene sulfonate at pH 7. The resulting solution maintains a low viscosity at 20°–25° C.

Desirable, fluid, pumpable slurries containing the polyhydroxy fatty acid amide surfactants at concentrations of said surfactants up to about 60% by weight can be prepared. This can be achieved by using somewhat higher levels of either the 1,2-propane diol or ethanol solvent, as noted hereinabove. Citric acid can be used in such fluidized mixtures, as can other polycarboxylate functional materials such as maleic and malic acids. The following examples further illustrate such pumpable concentrates of this type.

EXAMPLE X

A pumpable slurry of 50±1% polyhydroxy fatty acid amide $R^1$ methyl; $R^2=C_{12}-C_{18}$) which contains 5.1±0.5% propylene glycol having a viscosity of 1000 centipoise (max) at 35°±5° C. is prepared by adding thereto: water (30–35% by weight of final slurry), 1,2-propanediol (10±1% by weight of final slurry), citric acid (10±1% by weight of final slurry).

EXAMPLE XI

A pumpable slurry comprising 55±2% of the polyhydroxy fatty acid amide surfactant herein ($R^1$=methyl; $R^2=C_{12}-C_{18}$) which contains 6.2±0.6% propylene glycol is prepared using citric acid (10±0.2% by weight of slurry), ethanol (10±0.5% by weight of slurry), and water (balance; ca 20–25% by weight of slurry). Such slurries have a viscosity of about 1000 centipoise (max) at 35° C.

What is claimed is:

1. An improved process for preparing a stable, concentrated, fluidized mixture of a polyhydroxy fatty acid amide surfactant consisting of:

(a) preparing a stock mixture consisting of from about 30% to about 60%, by weight, of said polyhydroxy fatty acid amide surfactant in an aqueous solvent consisting of water or water containing about 15%, or less of organic solvents selected from the group consisting of methanol, ethanol, 1,2-propandiol, and mixtures thereof;

(b) heating said stock mixture to about 50° C.–80° C. sufficiently to provide an isotropic solution of said polyhydroxy fatty acid amide in said aqueous solvent;

(c) concurrently with or following step (b), adding an effective, viscosity controlling amount of a sodium salt of a carboxylate functional material selected from the group consisting of citrate, oxydisuccinate, tartrate, tartrate monosuccinate, tartrate disuccinate, gluconate, saccharate, and mixtures thereof to said isotropic solution of polyhydroxy fatty acid amide, whereby the viscosity of said solution remains at a pumpable viscosity below about 2000 cps, as measured at a temperature of about 30.6° C.

* * * * *